US012258701B2

(12) United States Patent
Scheckelhoff et al.

(10) Patent No.: US 12,258,701 B2
(45) Date of Patent: Mar. 25, 2025

(54) METHODS FOR DETERMINING AND PERFORMING CONDITIONING OPERATIONS WITHIN A LAUNDRY TREATMENT APPLIANCE

(71) Applicant: Haier US Appliance Solutions, Inc., Wilmington, DE (US)

(72) Inventors: Ryan James Scheckelhoff, Louisville, KY (US); Joshua Reeves, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 666 days.

(21) Appl. No.: 17/513,136

(22) Filed: Oct. 28, 2021

(65) Prior Publication Data

US 2023/0132718 A1 May 4, 2023

(51) Int. Cl.

| | |
|---|---|
| ***D06F 58/46*** | (2020.01) |
| ***D06F 34/05*** | (2020.01) |
| ***D06F 34/26*** | (2020.01) |
| ***D06F 103/04*** | (2020.01) |
| ***D06F 103/06*** | (2020.01) |
| ***D06F 103/32*** | (2020.01) |
| ***D06F 103/38*** | (2020.01) |
| ***D06F 105/56*** | (2020.01) |

(52) U.S. Cl.

CPC ..... *D06F 58/46* (2020.02); *D06F 34/05* (2020.02); *D06F 34/26* (2020.02); *D06F 2103/04* (2020.02); *D06F 2103/06* (2020.02); *D06F 2103/32* (2020.02); *D06F 2103/38* (2020.02); *D06F 2105/56* (2020.02)

(58) Field of Classification Search

CPC ... D06F 58/46; D06F 2103/38; D06F 2105/56

See application file for complete search history.

(56) References Cited

U.S. PATENT DOCUMENTS

| | | | | |
|---|---|---|---|---|
| 2004/0200093 | A1* | 10/2004 | Wunderlin | D06F 34/08 34/606 |
| 2007/0113421 | A1 | 5/2007 | Uhara | |
| 2010/0050464 | A1 | 3/2010 | Krzelowski | |
| 2010/0127854 | A1 | 5/2010 | Helvick | |
| 2012/0124859 | A1* | 5/2012 | May | D06F 34/28 34/572 |
| 2019/0330792 | A1* | 10/2019 | Del Maschio | D06F 58/38 |
| 2020/0087847 | A1* | 3/2020 | Choung | D06F 58/30 |
| 2021/0071347 | A1* | 3/2021 | Pattarello | D06F 58/34 |

FOREIGN PATENT DOCUMENTS

| | | | |
|---|---|---|---|
| CN | 112626817 | A | 4/2021 |
| EP | 2420613 | B1 | 1/2020 |
| JP | H05137899 | A | 6/1993 |

* cited by examiner

*Primary Examiner* — David J Laux

(74) *Attorney, Agent, or Firm* — Dority & Manning, P.A.

(57) ABSTRACT

A method of operating a dryer appliance includes predicting a removal point at which a laundry load will be removed from the tub of the dryer, the removal point being a certain amount of time after the completion of a main drying operation, determining a length of time required to perform a conditioning operation on the laundry load, determining a start time for the conditioning operation, and implementing a responsive action at the start time.

10 Claims, 3 Drawing Sheets

METHODS FOR DETERMINING AND PERFORMING CONDITIONING OPERATIONS WITHIN A LAUNDRY TREATMENT APPLIANCE

FIELD OF THE INVENTION

The present subject matter relates generally to laundry treatment appliances, and more particularly to methods of operating laundry treatment appliances incorporating conditioning operations.

BACKGROUND OF THE INVENTION

Laundry treatment appliances perform a variety of operations on laundry items, such as washing, rinsing, drying, and the like. In some instances, laundry treatment appliances include a washing machine and a separate dryer. During a full laundry operation, the washing machine performs a washing operation on a laundry load. The laundry load is subsequently transferred to the separate dryer which performs a drying operation. Typically, the drying operation is performed immediately after the washing operation to prevent the laundry load from developing undesirable effects such as mildew.

Moreover, users of laundry treatment appliances prefer to remove the laundry load from the dryer while the laundry load is still warm. Accordingly, users tend to prefer removing the laundry load from the dryer appliance soon after performing the drying operation. However, certain instances may prevent the user from immediately being able to remove the laundry load from the dryer appliance or the user may simply forget to remove the laundry load. After long waits for which the laundry load remains in the dryer appliance after completion of the drying operation, the laundry load may become cool, may develop wrinkles, or may develop an undesirable scent.

However, further improvements are necessary to ensure that the laundry load is in an optimal condition before being removed from the dryer appliance. Accordingly, a laundry treatment appliance that obviates one or more of the above-mentioned drawbacks would be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a laundry treatment appliance is provided. The laundry treatment appliance may include a tub provided within a cabinet. The method may include performing a drying operation on a laundry load within the laundry treatment appliance; predicting a removal point at which the laundry load will be removed from the tub; determining a conditioning time of the laundry load upon completion of the drying operation, the conditioning time being a length of time required to perform a conditioning operation; determining a start time of the conditioning operation by subtracting the conditioning time from the removal point; and implementing a responsive action at the determined start time.

In another exemplary embodiment of the present disclosure, a method of operating a dryer appliance is provided. The dryer appliance may include a tub rotatably provided within a cabinet and may be communicatively coupled to a washing machine appliance. The method may include determining that a first laundry load is present within the dryer appliance; determining that the washing machine appliance is performing a washing operation on a second laundry load while the first laundry load is present within the dryer appliance; determining a remaining washing time, the remaining washing time being an amount of time until a completion of the washing operation; and implementing a responsive action in response to determining the remaining washing time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
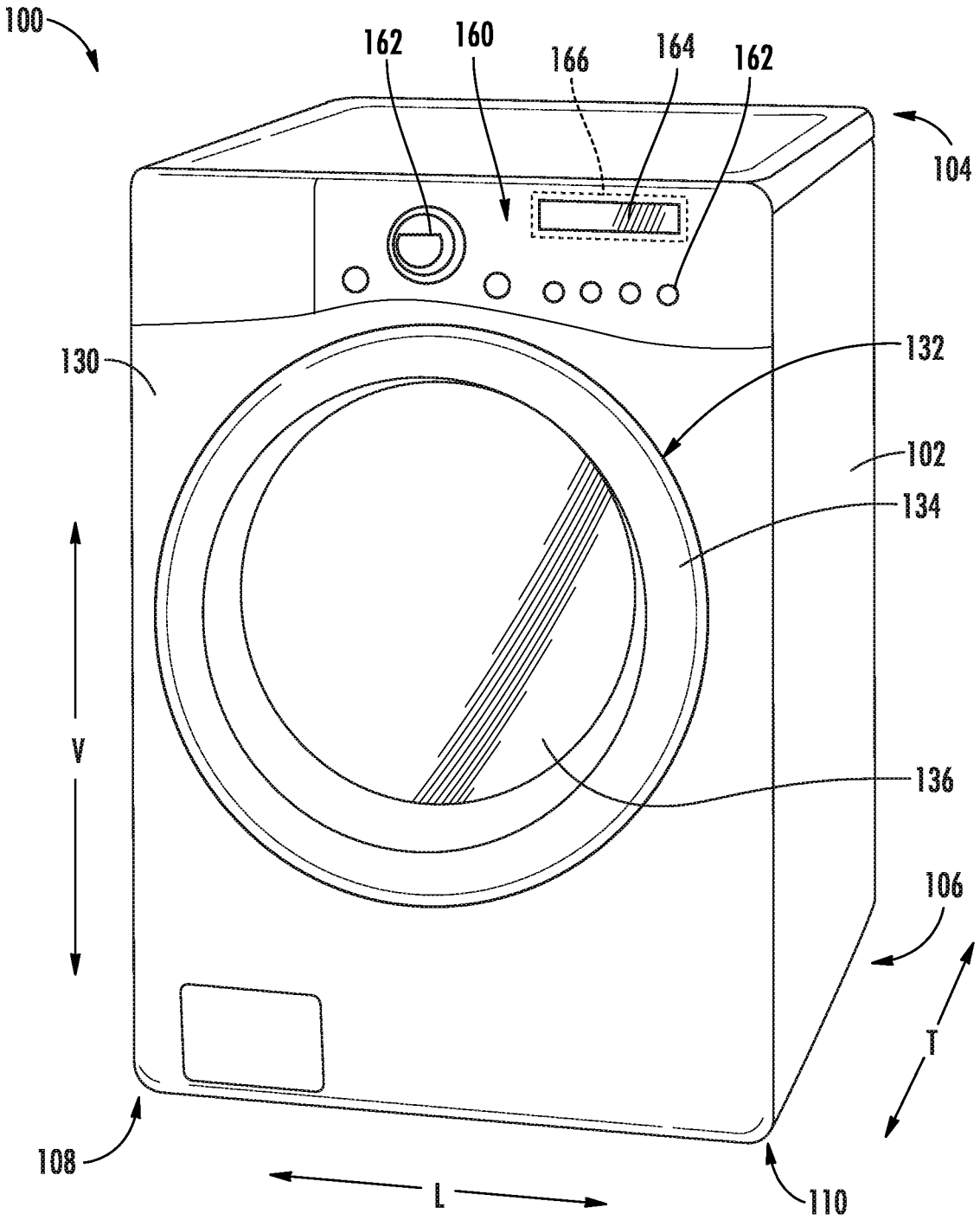
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "first," "second," and "third" may be used interchangeably to distinguish one element from another and are not intended to signify location or importance of the individual elements. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to the figures, FIG. 1 is a perspective view of an exemplary front-load dryer appliance 100 (e.g., combination washer-dryer appliance). As illustrated, dryer appliance 100 generally defines a vertical direction V, a lateral direction L, and a transverse direction T, each of which is mutually perpendicular, such that an orthogonal coordinate system is defined. Dryer appliance 100 includes a cabinet 102 that extends between a top 104 and a bottom 106 along the vertical direction V, between a left side 108 and a right side 110 along the lateral direction L, and between a front and a rear along the transverse direction T.

A dryer drum 120 may be received within cabinet 102 and define a drying chamber 126 that is configured for receipt of articles for drying. More specifically, dryer drum 120 may be rotatably mounted within cabinet 102 such that it is rotatable about a rotation axis. Generally, the rotation axis is defined non-parallel to the vertical direction V (e.g., closer to perpendicular than parallel). According to the illustrated embodiments, the rotation axis is substantially parallel to the transverse direction T. In this regard, dryer appliance 100 is generally referred to as a "horizontal-axis" or "front-load" dryer appliance 100.

While described in the context of a specific embodiment of front load dryer appliance 100, using the teachings disclosed herein it will be understood that front load dryer appliance 100 is provided by way of example only. Other combination washing machine or dryer appliances having different configurations, different appearances, or different features may also be utilized with the present subject matter as well.

Dryer drum 120 may define one or more features that extend into drying chamber 126 to assist in tumbling articles disposed within drying chamber 126 during operation of dryer appliance 100. For example, a plurality of baffles may extend from dryer drum 120 into drying chamber 126. In this manner, for example, the baffles may lift articles disposed in dryer drum 120 during rotation of dryer drum 120.

As shown in FIG. 1, cabinet 102 also includes a front panel 130 that defines, at least in part, an opening 132 that permits user access to dryer drum 120. More specifically, dryer appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to dryer drum 120 and a closed position (FIG. 1) prohibiting access to dryer drum 120. Optionally (e.g., in the case of a combination washer/dryer appliance), a lock assembly may be fixed to cabinet 102 to selectively lock or hold a free end of the door 134 to cabinet 102 when door 134 is in the closed position (e.g., during certain operations or wash cycles). For reference, door 134 is removed in FIG. 2 to show other elements of dryer appliance 100.

In some embodiments, a central body 136 of door 134 is provided on a perimeter rim that extends about (e.g., radially about) at least a portion of central body 136. In optional embodiments, central body 136 is provided as a window and permits viewing of dryer drum 120 when door 134 is in the closed position (e.g., during operation of dryer appliance 100). Generally, door 134 defines a footprint on a front portion of cabinet 102 (e.g., in a plane defined by the lateral direction L and the transverse direction T). For instance, when door 134 is in the closed position, central body 136 and the perimeter rim may extend across the footprint and thus cover the area of the front panel 130 within the footprint (e.g., when viewed along the transverse direction T directly in front of dryer appliance 100). The footprint may extend radially outward from opening 132. Thus, the footprint may encompass and define a larger width (e.g., diameter) than opening 132. In some such embodiments, central body 136 extends across and, optionally, within opening 132. The perimeter rim may extend radially outward from opening 132 and define the extrema of the footprint.

Figure 2:
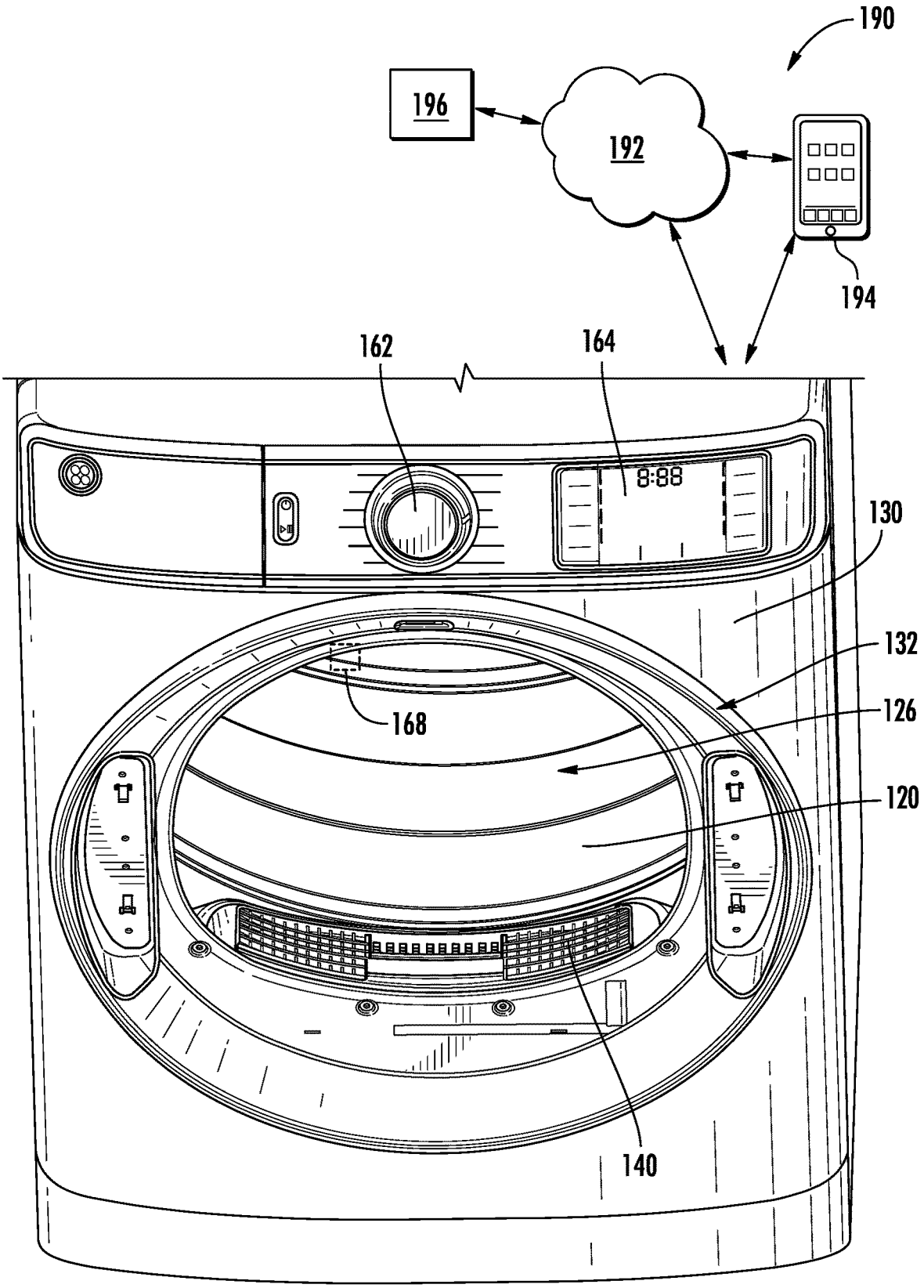
FIG. 2 provides a front perspective view of the exemplary dryer appliance of FIG. 1 with a door removed.

Door 134 may also include a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively (e.g., in the case of a combination washer/dryer), a front gasket or baffle may extend between dryer drum 120 and the front panel 130 about the opening 132 covered by door 134, further sealing dryer drum 120 from cabinet 102. For example, when door 134 is in the closed position, the baffle may contact central body 136 in sealing engagement therewith and within the footprint of door 134. Additionally or alternatively, a lint filter 140 may be provided at opening 132 (e.g., inserted radially into a space between front panel 130 and dryer drum 120, as shown in FIG. 2).

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of dryer appliance 100 is generally controlled by a controller or processing device 166. In some embodiments, controller 166 is in operative communication with (e.g., electrically or wirelessly connected to) control panel 160 for user manipulation to select dryer cycles and features. In response to user manipulation of control panel 160, controller 166 operates the various components of dryer appliance 100 to execute selected machine cycles and features (e.g., as part of a drying operation).

As mentioned above, FIG. 2 is a front view of an exemplary dryer appliance with door 134 removed and showing lint filter 140 in an inserted position. As shown in FIG. 2, lint filter 140 may be inserted into a space between front panel 130 and dryer drum 120. Lint filter 140 may be inserted downward (e.g., in the vertical direction V) radially at or near opening 132. It should be noted that the position of filter 140 in FIG. 2 is merely an example, at a location or position of filter 140 may be adjusted according to specific applications.

Dryer appliance 100 may include a temperature sensor 168. Temperature sensor 168 may be provided within tub 120, for example, to detect a temperature within tub 120. In some embodiments, temperature sensor 168 is located at or near opening 132. As used herein, "temperature sensor" or the equivalent is intended to refer to any suitable type of temperature measuring system or device positioned at any suitable location for measuring the desired temperature. Thus, for example, temperature sensor 168 may each be any suitable type of temperature sensor, such as a thermistor, a thermocouple, a resistance temperature detector, a semiconductor-based integrated circuit temperature sensors, etc. In addition, temperature sensor 168 may be positioned at any suitable location and may output a signal, such as a voltage, to a controller that is proportional to and/or indicative of the temperature being measured. Although exemplary positioning of temperature sensors is described herein, it should be appreciated that dryer appliance 100 may include any other suitable number, type, and position of temperature, humidity, and/or other sensors according to alternative embodiments.

Referring still to FIG. 2, a schematic diagram of an external communication system 190 will be described according to an exemplary embodiment of the present subject matter. In general, external communication system 190 is configured for permitting interaction, data transfer, and other communications with dryer appliance 100. For example, this communication may be used to provide and receive operating parameters, cycle settings, performance characteristics, user preferences, user notifications, or any other suitable information for improved performance of dryer appliance 100. Additionally or alternatively, external communication system 190 may facilitate communication between dryer appliance 100 and one or more additional appliances, such as a washing machine appliance.

External communication system 190 permits controller 166 of dryer appliance 100 to communicate with external devices either directly or through a network 192. For example, a consumer may use a consumer device 194 to communicate directly with dryer appliance 100. For example, consumer devices 194 may be in direct or indirect communication with dryer appliance 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with dryer appliance 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g., TCP/IP, HTTP, SMTP, FTP), encodings or formats (e.g., HTML, XML), and/or protection schemes (e.g., VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, receive user notifications or instructions, etc. In addition, consumer device 194 and remote server 196 may communicate with dryer appliance 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

Now that the construction of dryer appliance 100 and the configuration of controller 166 according to exemplary embodiments have been presented, an exemplary method 200 of operating a dryer appliance will be described. Although the discussion below refers to the exemplary method 200 of operating dryer appliance 100, one skilled in the art will appreciate that the exemplary method 200 is applicable to the operation of a variety of other dryer appliances, such as combination washer/dryer appliances. In exemplary embodiments, the various method steps as disclosed herein may be performed by controller 166 or a separate, dedicated controller.

Figure 3:
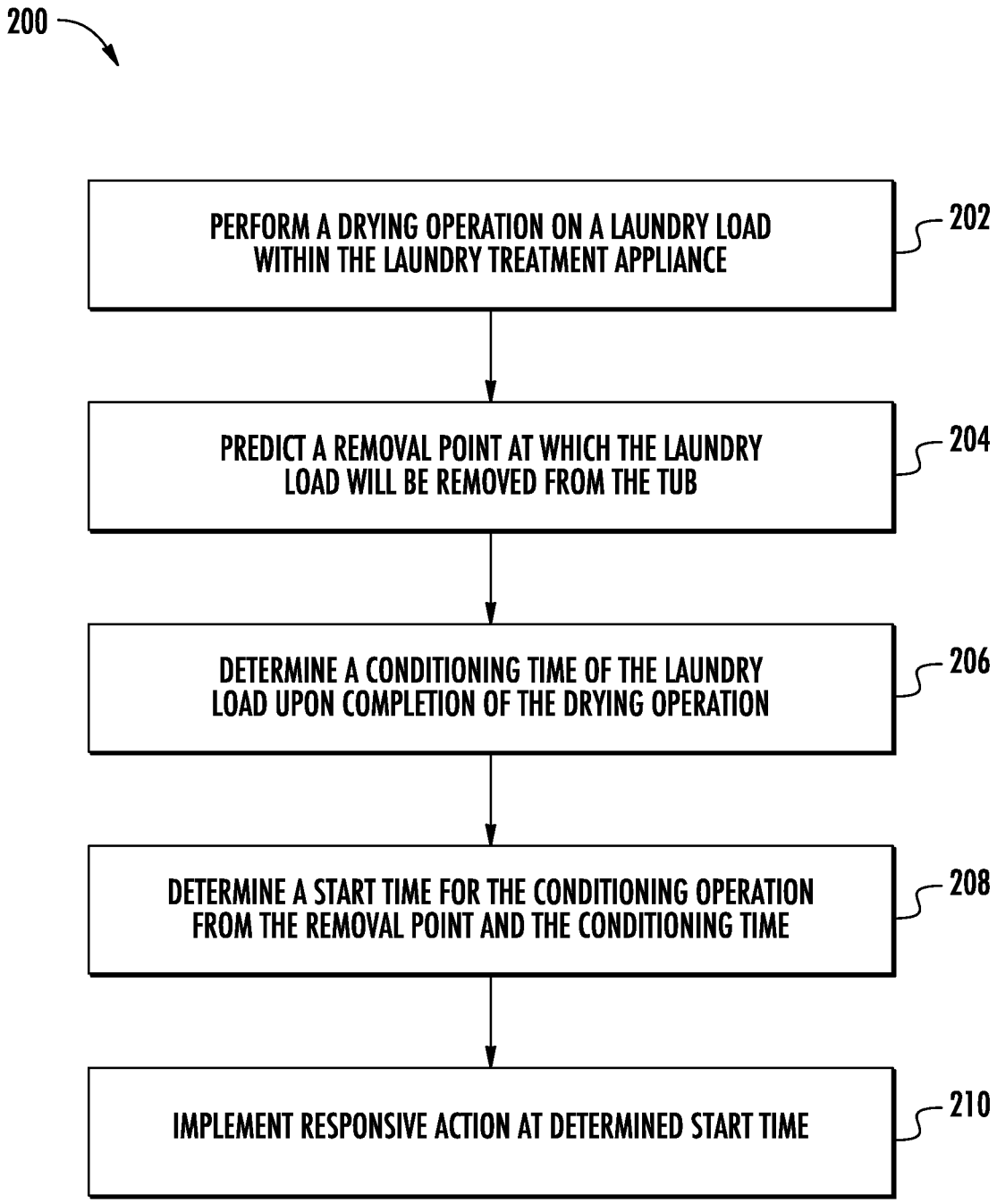
FIG. 3 provides a flowchart illustrating a method of operating a dryer appliance according to one or more embodiments of the present disclosure.

Referring now to FIG. 3, at step 202, method 200 may include performing a drying operation on a laundry load within the laundry treatment appliance. In detail, a user may move a laundry load from a washing machine appliance to the dryer appliance (e.g., dryer appliance 100) upon a completion of a washing operation within the washing machine appliance. The drying operation may be any suitable drying operation capable of being performed within a dryer appliance, as would be understood. At this point, the user may not know when the laundry load will be removed from the dryer appliance upon completion of the drying operation. For instance, the user may initiate the drying operation and subsequently leave the vicinity of the dryer appliance for an extended period of time. For one example, the drying operation may be started immediately before the user plans to sleep. For another example, the drying operation may be started before the user leaves the house (or other location of the dryer appliance) for, e.g., work or errands.

Accordingly, at step 204, method 200 may include predicting a removal point at which the laundry load will be removed from the tub. In detail, a controller (e.g., controller 166) of the dryer appliance may monitor a series of drying operations performed by the dryer appliance. In some embodiments, a machine learning model may be incorporated within the controller to record, analyze, and store information regarding each drying operation. Additionally or alternatively, the controller may store certain attributes or information regarding drying operations. The information may include routine start times of drying operations, typical length of time that laundry loads remain in the tub of the dryer appliance after completion of the drying operation, various time points at which the laundry load is removed from the tub, and the like.

Accordingly, the controller may store heuristic (or empirical) data regarding multiple drying operations. From this, the controller may establish routines or schedules relating to drying operations (or washing and drying operations). Using this data, the controller may begin to make predictions on when the laundry loads may be removed from the dryer appliance. As described above, these predictions made be determined entirely from heuristic data (e.g., recorded removal times of the laundry loads, recorded idle times for which the laundry loads remain within the tub, etc.). Additionally or alternatively, certain artificial intelligence and/or machine learning models may be incorporated to learn various behaviors relating to the dryer appliance. For instance, a machine learning model incorporating one or more neural networks may assist in forming predictions on removal times of the laundry loads.

At step 206, method 200 may include determining a conditioning time of the laundry load upon completion of the drying operation. The conditioning time may be a length of time required to perform a conditioning operation. For instance, the conditioning operation may include one or more of a warm up cycle, a softening cycle, a scent addition cycle, a fluff cycle, or the like. In determining the conditioning time, the controller may consider one or more properties, factors, or conditions related to the laundry load.

For instance, the controller may consider a size of the laundry load. The size of the laundry load may be determined in a multitude of ways. In some embodiments, the size of the laundry load is determined during a washing operation (performed before the drying operation). According to this embodiment, the dryer appliance may be in remote communication with a washing machine appliance. Thus, the controller of the dryer appliance may request or retrieve a stored laundry load size as determined by the washing machine appliance during the washing operation. In another embodiment, the dryer appliance requests or retrieves an input as to the size of the laundry load. For instance, the user may manually input a size or estimated size of the laundry load directly to the dryer appliance, e.g., before initiating the drying operation. Additional or alternative methods for determining the size of the laundry load may include sensing a weight of the laundry load within the tub, determining a voltage input to a motor rotating the tub, detecting an air flow through the tub, etc.

In another embodiment, the controller may consider a temperature within the tub in determining the conditioning time. For instance, the controller may request or retrieve a temperature from a temperature sensor (e.g., temperature sensor 168) within the tub prior to initiating the conditioning operation. Thus, for example, the lower the detected temperature at the commencement of the conditioning cycle, the longer the conditioning operation may run. The detected temperature may be considered together with the predicted removal time to establish or determine an optimal conditioning time to provide adequately heated, scented, or fluffed laundry loads. It should be noted that any combination of considerations may be incorporated in determining the conditioning time. Further, additional properties that the controller may consider include a time of day of the drying operation, a time of day of the predicted removal point, a type of the laundry load (e.g., cottons, delicates, towels, etc.), or the like.

In another embodiment, the controller may determine that the temperature within the tub is below a predetermined temperature. The predetermined temperature may be input by the user (e.g., before performing the drying operation). The temperature within the tub may be continually monitored upon a completion of the drying operation. Accordingly, in at least one embodiment, the controller may consider the temperature within the tub without predicting a removal time. In detail, upon completion of the drying operation, the controller may monitor the temperature within the tub, e.g., via the temperature sensor. When the temperature drops below the predetermined temperature (e.g., a threshold temperature), the controller may implement a responsive action (described in more detail below). Thus, the conditioning operation may be performed with or without predicting a removal time.

At step 208, method 200 may include determining the start time of the conditioning operation by subtracting the conditioning time from the removal point. In detail, the controller may determine an optimal time to initiate a selected or determined conditioning operation utilizing the determined conditioning time and the removal point. Once the removal point has been estimated, the controller may anticipate that the conditioning operation needs to be initiated before the removal point. Since the determined conditioning time is the time required to perform the conditioning operation, the controller may count back from the predicted removal point to determine the start time. For an example, if the predicted removal time is 8:00 AM and the determined conditioning time is 10 minutes, the controller determines the start time to be approximately 7:50 AM. In some embodiments, the controller may modify the determined start time by a predetermined percentage or ratio, as will be explained in more detail below.

At step 210, method 200 may include implementing a responsive action at the determined start time. In detail, upon determining the optimal start time for the conditioning operation, the controller may perform one of several responsive actions. The implemented responsive action may be automatically initiating the conditioning operation. For instance, a user may select (e.g., prior to performing the drying operation) an option to have the dryer appliance automatically initiate a selected conditioning operation. Accordingly, utilizing the example above, when the start time is determined to be 7:50 AM, the controller may immediately initiate the conditioning operation at 7:50 AM. Advantageously, the laundry may be in a desirable condition at the predicted time that the user will remove it from the tub.

In another embodiment, the responsive action includes sending a prompt to a remote device of the user. For instance, prior to initiating the drying operation, the user may select an option to be notified as to the predicted removal time before initiating the conditioning operation. In detail, upon determining the start time, at a point at or around the determined start time, the controller may send a notification to the remote device (e.g., mobile phone, smart watch, tablet, etc.) of the user. The notification may include a request to initiate the conditioning operation. For instance, the user may be notified that the predicted removal time is approaching. Moreover, the notification may include the determined conditioning time. From this notification, the user may instruct the dryer appliance to initiate the conditioning operation. According to this example, the controller may include the modification to the determined start time, as described above. This modification may give a time buffer to the user such that the user may consider the request before initiating the conditioning operation. Accordingly, the dryer appliance may still achieve the predicted removal time by accounting for a reaction or answer from the user.

Additionally or alternatively, the notification may include one or more options. For instance, the notification may include an option to delay the start of the conditioning operation. Further, the notification may include an option to forego the conditioning operation. Further still, the notification may include an option to select, change, or modify the conditioning operation before initiation. It should be understood that additional options may be included in the notification, and the disclosure is not limited to the examples given herein.

The conditioning operation may include one or more features for improving a condition of the laundry load prior to removal from the tub. For instance, as discussed above, the laundry load may spend an extended length of time (e.g., an idle time) within the tub before being removed by the user. This idle time may render the laundry load colder than desirable, wrinkled, flat, or otherwise unsatisfactory. Additionally or alternatively, the idle time may lead users to incorrectly determine that the laundry load is still wet or damp, leading to unnecessary service calls or redundant drying operations.

Accordingly, the conditioning operation may include a warming operation or warm-up cycle. The warm-up cycle may include a short duration cycle of heated air into the drum. The warm-up cycle may further include a rotation of the tub to tumble the laundry load. Thus, the laundry load may have a desirable tactile sensation at the predicted removal time. Additionally or alternatively, the conditioning operation may include a scent operation or cycle. The scent cycle may supply a selected or predetermined scent to the laundry load (e.g., via an additive or the like). The scent cycle may be performed together with the warm-up cycle or in place of the warm-up cycle.

In another embodiment of the present disclosure, the dryer appliance may be in remote connection with a washing machine appliance. For instance, the dryer appliance and the washing machine appliance may communicate directly with one another, or may communicate via a network (e.g., network 192). The dryer appliance may receive routine signals from the washing machine appliance regarding washing operations, for example. Thus, the initiation of the conditioning operation may incorporate data from a washing operation of the washing machine appliance.

For instance, the controller may determine that a first laundry load is present within the dryer appliance (e.g., within the tub). The controller may determine that the first laundry load has an idle time greater than a predetermined limit. In at least one example, the idle time may be greater than about 45 minutes. In another example, the controller may determine a temperature within the tub of the dryer appliance (e.g., via the temperature sensor). Similar to the example above, the controller may determine that the determined temperature is below a predetermined temperature. The controller may then determine that the conditioning load should be applied to the first laundry load.

The controller may further determine that a second laundry load is present within the washing machine appliance. For instance, the controller may receive a signal from the washing machine appliance that a washing operation is being performed on the second laundry load. The signal may include details regarding the washing operation, such as a remaining time, a size of the second laundry load, a type of the second laundry load, etc. Accordingly, the controller may determine that the second laundry load will need to be inserted into the dryer appliance for a drying operation.

Thus, the controller may determine the optimal start time for the first laundry load (sitting idle within the dryer appliance). The optimal start time may consider a calculated duration of the conditioning operation. Moreover, the optimal start time may consider one or more additional factors. For instance, the optimal start time may consider an additional folding time for the first laundry load. In detail, the controller may consider an approximate amount of time that the user may need to fold the first laundry load (e.g., after completion of the conditioning operation). Thus, in determining the optimal start time for the conditioning operation, the controller may consider the time remaining in the washing cycle of the second laundry load, the length of time required to perform the conditioning operation, and the approximate folding time required to fold the first laundry load. By adding the folding time to the conditioning time, the controller may determine a total preparation time. The total preparation time may be equal to the remaining time on the washing operation of the second laundry load.

As mentioned, the folding time may be a time required to fold the first laundry load. In detail, the controller may store a plurality of folding times. Each stored folding time may be associated with a particular load size, load type, or the like. Thus, the controller may retrieve the associated folding time according to the attributes either determined or input regarding the first laundry load.

According to the above-described embodiments, a dryer appliance may determine or calculate a predicted time at which a laundry load will be removed from the dryer appliance. The controller may consider one or more factors or properties regarding the laundry load in predicting the removal time. Thus, when the laundry load is idle within the tub of the dryer appliance for longer than a predetermined time, the controller may either initiate a conditioning operation or send a notification to a user to initiate the conditioning operation. Advantageously, the laundry load may be presented to the user at the predicted removal time in a desirable condition. The conditioning operation may include one or both of a warming operation and a scent operation. In some embodiments, the controller may determine that a washing load will imminently be moved to the dryer appliance. If there is an idle laundry load within the dryer, the controller may calculate a conditioning time required to perform the conditioning operation on the laundry load before the washing load is to be transferred to the dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry treatment appliance, the laundry treatment appliance comprising a tub provided within a cabinet, the method comprising:

performing a drying operation on a laundry load within the laundry treatment appliance;

predicting a removal point at which the laundry load will be removed from the tub;

determining a conditioning time of the laundry load upon completion of the drying operation, the conditioning time being a length of time required to perform a conditioning operation;

determining a start time of the conditioning operation by subtracting the conditioning time from the removal point; and implementing a responsive action at the determined start time.

2. The method of claim 1, further comprising:

determining one or more properties relating to the laundry load upon completion of the drying operation; wherein the one or more properties comprise a temperature within the tub upon completion of the drying operation, a time of day, a size of the laundry load, and a type of the laundry load.

3. The method of claim 2, further comprising:

determining an idle time of the laundry load, the idle time being an amount of time between a completion of the drying operation and the start time, wherein the idle time is predicted according to heuristic data.

4. The method of claim 2, further comprising:

determining a load conditioning operation time, the load conditioning operation time being an amount of time required to perform a load conditioning operation.

5. The method of claim 4, wherein the responsive action comprises performing the load conditioning operation.

6. The method of claim 4, wherein the responsive action comprises sending, via a remote connection, a prompt to a remote device of a user, the prompt comprising a request to perform the load conditioning operation.

7. The method of claim 4, wherein the load conditioning operation comprises at least one of a warming operation to supply heated air to the laundry load and a scent operation to supply a predetermined scent to the laundry load.

8. The method of claim 2, further comprising:

determining, via a temperature sensor provided within the tub, that a temperature within the tub is below a predetermined temperature limit; and implementing the responsive action in response to determining that the temperature within the tub is below the predetermined temperature limit.

9. The method of claim 8, wherein the responsive action comprises performing the conditioning operation.

10. The method of claim 8, wherein the responsive action comprises sending, via a remote connection, a prompt to a remote device of a user, the prompt comprising a request to perform the conditioning operation.

* * * * *